US007827921B2

(12) United States Patent
Shields et al.

(10) Patent No.: US 7,827,921 B2
(45) Date of Patent: Nov. 9, 2010

(54) TILTING NESTABLE TABLE AND CHAIR SET

(75) Inventors: Michael R. Shields, Greensboro, NC (US); Jerald W. Nichols, Jasper, IN (US); Mark R. Dilger, Ferdinand, IN (US)

(73) Assignee: Ditto Sales, Inc., Jasper, IN (US)

( * ) Notice: Subject to any disclaimer, the term of this patent is extended or adjusted under 35 U.S.C. 154(b) by 267 days.

(21) Appl. No.: 12/112,093

(22) Filed: Apr. 30, 2008

(65) Prior Publication Data

US 2009/0273214 A1 Nov. 5, 2009

(51) Int. Cl.
*A47B 57/00* (2006.01)
*A47B 3/02* (2006.01)

(52) U.S. Cl. ..... 108/91; 108/119

(58) Field of Classification Search ..... 108/91, 108/119, 97, 93, 115, 157.15, 157.1
See application file for complete search history.

(56) References Cited

U.S. PATENT DOCUMENTS

| | | | | |
|---|---|---|---|---|
| 1,754,199 | A * | 4/1930 | Gibson | 108/91 |
| 2,587,881 | A | 3/1952 | Oakes | |
| 2,762,669 | A * | 9/1956 | Watson | 108/91 |
| 2,851,166 | A * | 9/1958 | Block | 211/27 |
| 2,871,073 | A * | 1/1959 | Swanson | 108/91 |
| 3,134,193 | A * | 5/1964 | Huffer | 248/463 |
| 4,522,446 | A | 6/1985 | Sheridan | |
| 5,613,448 | A * | 3/1997 | Petty | 108/91 |
| 6,085,669 | A | 7/2000 | Marchand et al. | |
| 6,378,943 | B1 | 4/2002 | Beggs et al. | |
| 6,742,839 | B2 | 6/2004 | Piretti | |

* cited by examiner

*Primary Examiner*—Milton Nelson, Jr.
(74) *Attorney, Agent, or Firm*—Maginot, Moore & Beck LLP

(57) ABSTRACT

A portable chair and table set is provided that is tiltable and nestable to simplify and accommodate compact storage. The chair includes a seat shell that is pivotably mounted to a nestable support frame. Hinges connect the shell to the frame and are configured to hold the seat shell in a tilted configuration for storage. In this tilted configuration, several chairs can be horizontally nested so that the overall length of the nest chairs is minimized. Similarly, the table includes a table top having a unitary desk surface and modesty panel that is pivotably mounted to a support frame by hinges that are configured to hold the table top in a tilted configuration that allows horizontal nesting of several tables in a minimal overall length. The hinges can be easily disengaged by manual movement of the table top to its in use position.

11 Claims, 8 Drawing Sheets

(Tilted position)

(In-use position)

TILTING NESTABLE TABLE AND CHAIR SET

BACKGROUND

The present invention relates generally to the field of portable furniture and in particular to a chair and a table that are nestable.

Traditional stackable chairs include a pair of inverted-U-shaped leg members attached to opposite sides of a generally horizontal seat. A generally L-shaped back support frame interconnects with the leg members and extends upwardly from the rear of the seat to support a back cushion. This type of chair is stacked by placing the inverted-U-shaped leg members of one chair over the top of the leg members of another chair, such that the seat of the upper chair is supported just above the seat of the lower chair. However, chairs of this type are limited by their vertical stacking requirement, especially with respect to aesthetics. Moreover, vertical stacking can be cumbersome, tiresome and even dangerous if a stack is too tall.

One alternative has been a traditional folding chair in which the entire chair folds relatively flat. A similar approach has been taken for tables. This approach requires special mechanisms and linkages that are not always easily deployed and that are susceptible to pinching the fingers of the person opening or closing the chair or table. Moreover, while the flattened folded configuration reduces the storage profile of the chair or table, stands or carriages are often required to support the folded furniture.

In some settings many chairs and tables are required, such as in a conference or training room, an office or a classroom. In these settings portability is important since the chairs and tables may need to be frequently deployed, stowed, and reconfigured. Storage is always an important criteria, and particularly minimizing the space required to store a full complement of tables and chairs. Further, the chairs and tables must be durable and rugged, yet preferably mechanically simple, easily assembled, lightweight, and low-cost. Still further, many consumers want an aesthetically pleasing appearance and a design that can take advantage of modern materials. There is always a need for an improved chair and table that meets these criteria.

SUMMARY

In order to meet these needs, a chair and table set is provided that is tiltable and nestable to simplify and accommodate compact storage. The chair includes a seat shell that is pivotably mounted to a nestable support frame. Hinges connect the shell to the frame and are configured to hold the seat shell in a tilted configuration. In this tilted configuration, several chairs can be horizontally nested so that the overall length of the stack is minimized. In certain features, the hinges incorporate a detent-type arrangement that holds the shell in the tilted configuration but that is easily disengaged by manual movement of the seat shell to its "in use" or seating position.

Similarly, the table includes a table top having a unitary desk surface and modesty panel that is pivotably mounted to a support frame by hinges. As with the chair, the hinges of the table are configured to hold the table top in a tilted configuration that allows horizontal nesting of several tables in a minimal overall length. The hinges can be easily disengaged by manual movement of the table top to its in use position.

The chair and table disclosed herein are extremely portable, being preferably provided with caster wheels or rollers on the legs of the furniture articles. The chair and table may be transported in either the stored or the in use position.

DESCRIPTION OF THE ILLUSTRATED EMBODIMENTS

Figure 1:
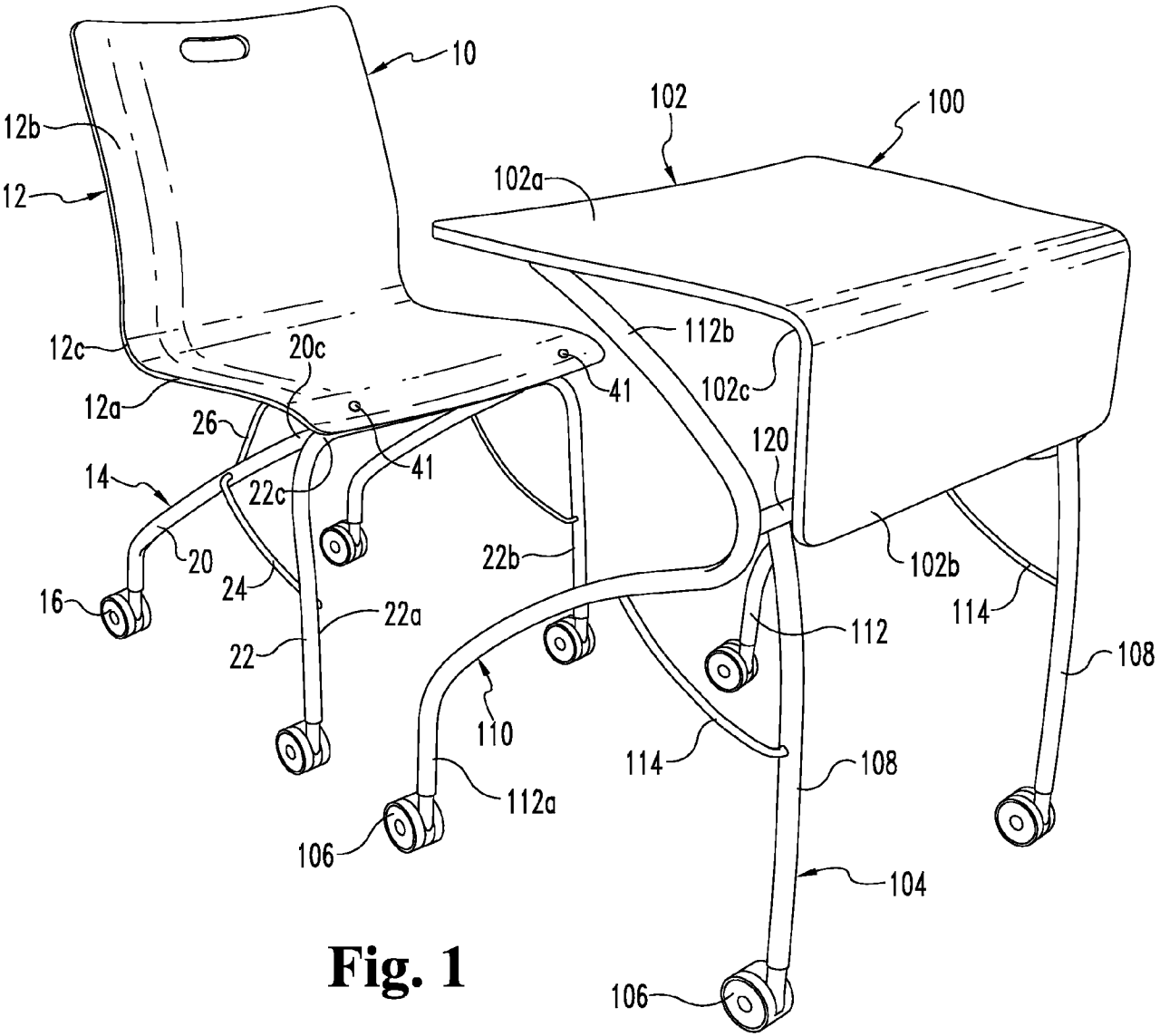
FIG. 1 is a perspective view of one embodiment of a tiltable nestable table and chair set shown in their usable positions.
Figure 2:
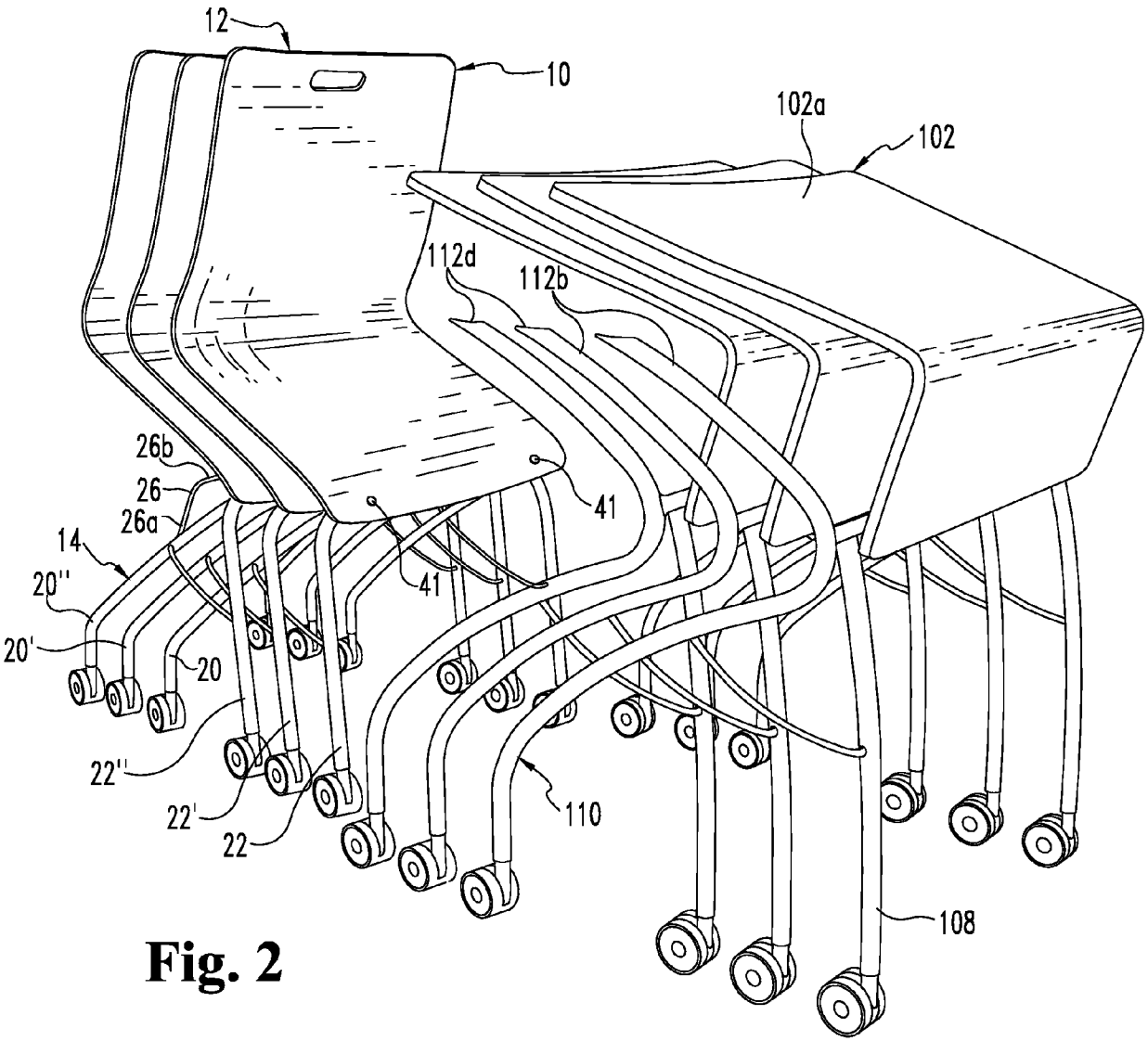
FIG. 2 is a perspective view of the table and chair set depicted in FIG. 1 shown in their nested configurations.

One embodiment of a tiltable nestable table and chair set is shown in its usable and stowed configurations in FIGS. 1-2. The set includes a chair 10 that is designed to be tilted and nested in the manner shown in FIG. 2. The set further includes a table or desk 100 that is likewise designed to be tilted and nested for storage in the manner shown in FIG. 2. The chair includes a seat shell 12 mounted on a base 14. The seat shell includes a seat bottom 12*a* and a back 12*b* joined at a curved section 12*c*. In a preferred embodiment, the seat shell 12 is unitary or one-piece, with the seat and back joined by the curved section 12*c*. The shell is formed of a material that is sufficiently strong to maintain its general L-shape but flexible enough to permit some flexing about the curved section. The lower edge 12*d* of the seat bottom 12*a* is preferably rolled or slightly curved for the comfort of the user's thighs. The back 12*b* may be slightly concave, as best seen in FIG. 4, to form around the back of the person sitting in the chair.

The base 14 of the chair 10 is in a tubular configuration that is strong, yet lightweight, while providing an aesthetically pleasing contour. The base 14 includes a rear leg frame 20 that has opposite leg portions 20*a, b* joined by a horizontal bar 20*c*. The base further includes a front leg frame 22 that also includes opposite leg portions 22*a, b* joined by a horizontal bar 22*c*. A brace bar 24 spans between corresponding front and rear leg portions 20*a* and 22*a*, for instance, to add rigidity to the tubular base construction. It can be appreciated that the tubular elements of the base 14 can be constructed using a variety of known fabrication processes. For instance, where the frames 20 and 22 are formed from metal tubes, the tubes may be bent and welded according to known techniques. In the illustrated embodiment, the ends of each of the leg portions 20*a, b* and 22*a, b* are fitted with casters 16, but other suitable feet may be used.

Figure 3:
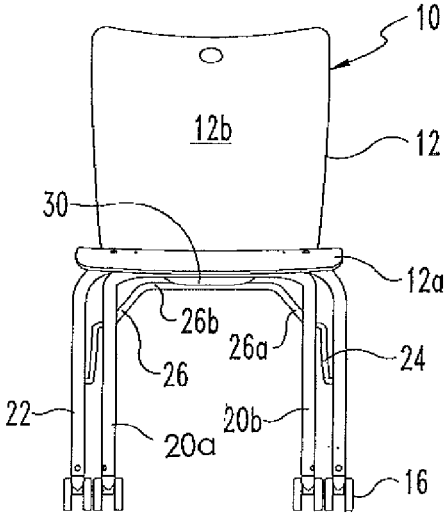
FIG. 3 is a front view of a chair from the set shown in FIG. 1, with the chair in its usable seating position.

To facilitate nesting of the chair 10, the rear leg frame 20 is configured to reside inboard of the front leg frame 22, as most clearly seen in FIGS. 2 and 3. The rear leg frame 20 of one chair, such as chair 10 in FIG. 2, can fit between the front leg frames 22' and 22" of adjacent chairs when the three chairs are nested and stacked horizontally.

Figure 4:
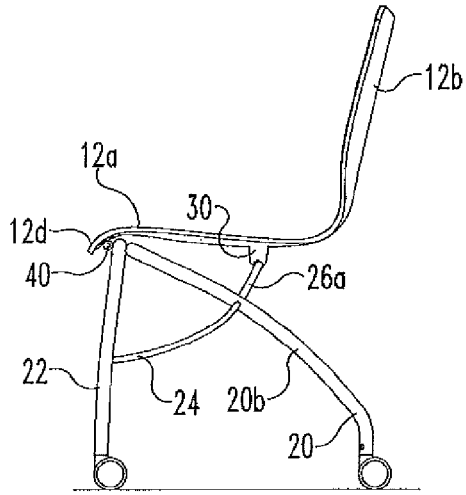
FIG. 4 is a side view of the chair illustrated in FIG. 3.
Figure 6:
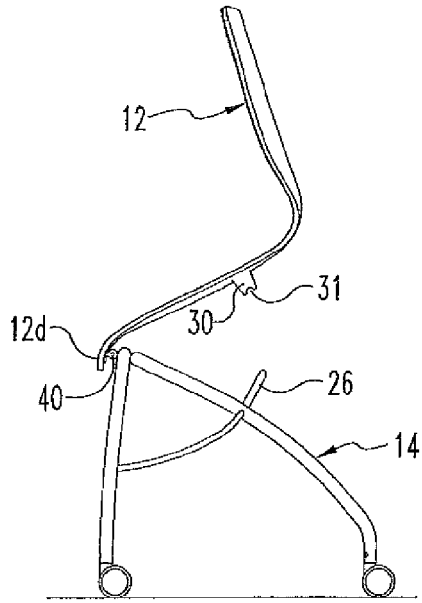
FIG. 6 is a side view of the chair illustrated in FIG. 5.

As best seen in FIGS. 3, 4 and 6, the seat bottom 12*a* of the seat shell 12 is supported on a transverse support bar 26 that spans between the leg portions 20*a*, 20*b* of the rear leg frame 20. The bar 26 is in a general U-shape, the angled arms 26*a* affixed to the leg portions and supporting a horizontal portion 26*b* situated beneath the seat of the shell. The underside of the seat bottom 12*a* is provided with a bumper 30 that is configured to contact and partially engage the horizontal portion 26*b* when the seat is in the usable position. The bumper 30 is preferably elongated to dissipate the load borne by the bumper and the support bar 26 along a greater length. The bumper may further be formed of a slightly compressible material to soften the support of the seat shell. The bumper 30 may incorporate a semi-circular surface 31 (best seen in FIG. 6) that conforms to the outer surface of the support bar. The semi-circular surface may even be configured to form a snap-fit with the support bar. As shown in FIG. 4, the bumper 30 helps hold the position of the seat bottom on the support bar 26 supporting the seat shell 12 when the shell is pivoted downward, as shown in FIGS. 3-4. It can further be appreciated that the support bar is sized to fit underneath the horizontal bar 22*c* (FIG. 1) of the front leg frame 22 when one chair is nested within another chair.

Figure 5:
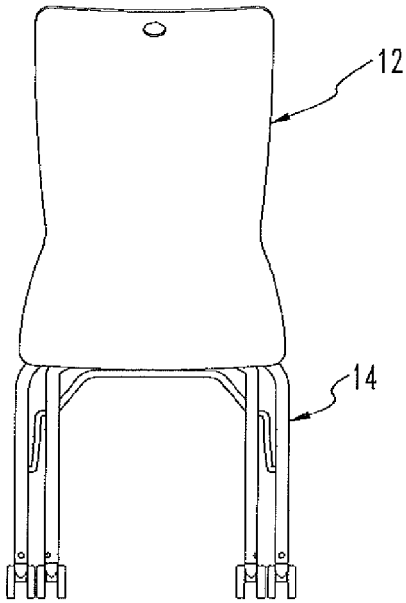
FIG. 5 is a front view of the chair from the set shown in FIG. 2, with the chair in its tilted position for nesting.

As shown in FIGS. 5-6, the chair 10 is designed to tilt and more specifically for the seat shell 12 to tilt forward about a pivot axis beneath the forward edge 12*d* of the seat bottom 12*a*. In a specific embodiment, the seat shell can be tilted forward to an angle of about 27.5° relative to the horizontal. It can be appreciated that this angle of tilt allows the seat to remain stable even when in the tilted configuration. In other words, at the 27.5° angle the center of gravity of the tilted seat shell 12 is vertically aligned behind the effective center of gravity of the base 14. A greater angle of tilt can leave the chair prone to tip over. On the other hand, a significantly lesser angle of tilt will not optimize the nesting capability of the chair. When a collection of chairs are nested horizontally, the tilted seat shells nest within each other, even as the chair bases also nest, as shown in FIG. 2. One benefit of the chair 10 disclosed herein is that the horizontal nested length is a short as possible. A lower seat shell tilt angle can lengthen the nested length since the depth of overlap between successive chairs is reduced as the shell approaches its normal horizontal in use position. In the illustrated embodiment, the nested length of three chairs shown in FIG. 2 is less than 30% longer than the overall length of a single chair. In other words, if the floor length or wheelbase of one embodiment of the chair 10 is about 20.5 inches, then a horizontal length of the three chairs shown in FIG. 2 is about 26 inches.

It can be appreciated that when the chair 10 is in its usable orientation, the seat shell 12 is pivoted down and supported by the bumper 30 and support bar 26, as shown in FIGS. 3-4. The weight of the shell, as well as the weight of the person sitting on the chair, keep the shell in position. However, when the seat shell 12 is tilted for storage, as shown in FIG. 2, gravity will cause the shell to fall unless some mechanism is in place to hold the shell up. Thus, in one embodiment of the chair 10, the seat bottom 12*a* is pivotably connected to the horizontal bar 22*c* by hinges 40 configured to temporarily "lock" or hold the position of the seat bottom. In a preferred embodiment, two such hinges 40 are provided, as indicated by the location of the fastening rivets 41 at the front edge 12*d* of the seat bottom 12*a* illustrated in FIGS. 1 and 2.

Figure 8:
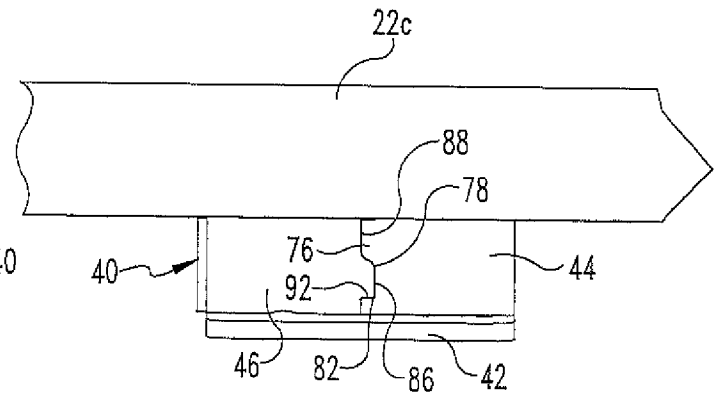
FIG. 8 is an enlarged view of the hinge system for the chair shown in tilted configuration of FIGS. 5-6.
Figure 7:
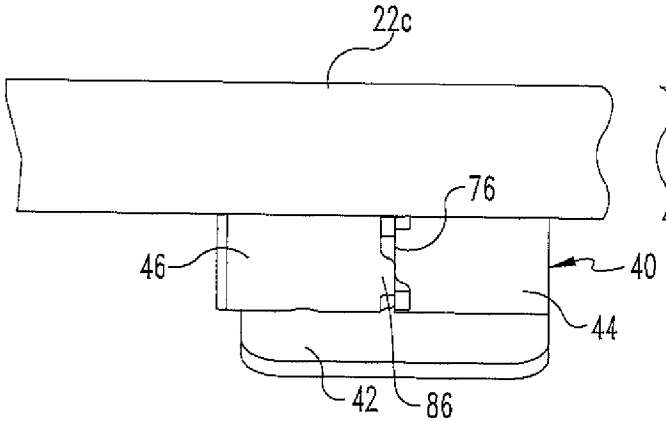
FIG. 7 is an enlarged view of the hinge system for the chair shown in FIGS. 3-4.
Figure 9B:
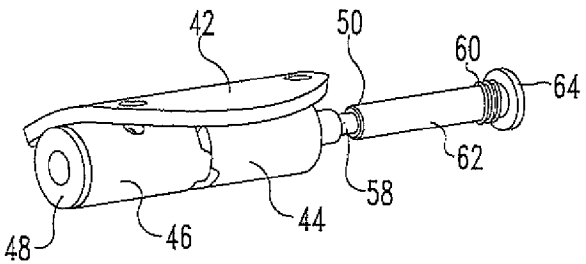
FIGS. 9*a-b* are perspective exploded views of the hinge system shown in FIG. 8.
Figure 9A:
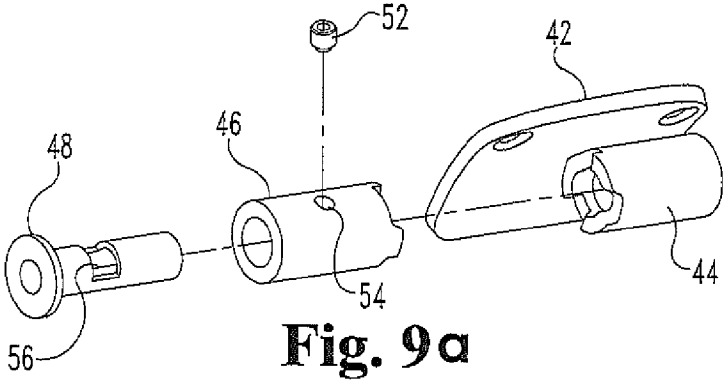

Details of the construction of the hinge 40 are shown in FIGS. 9*a*-13*c*. An exploded view of the hinge is depicted in FIGS. 9*a*, 9*b*, with FIG. 9*b* showing the hinge partially assembled. The hinge 40 includes a mounting plate 42 that is affixed to the underside of the seat bottom 12*a* in a conventional manner, such as by mechanical fasteners like screws or rivets. A female barrel 44 is affixed to the mounting plate 42 in a known manner, such as by welding or mechanical fasteners. The female barrel 44 thus pivots with the seat bottom when the seat shell is tilted. The female barrel is operatively engaged to a male barrel 46 that is affixed to the horizontal bar 22*c* of the front leg frame 22, as shown in FIGS. 7, 8. Again, the male barrel may be affixed to the bar in a conventional manner, such as by welding, mechanical fasteners or mounting brackets. The male barrel 46 is fixed to the chair frame 14 to anchor the pivot action of the chair shell.

The two barrels 44 and 46 are linked by an end cap 48 that integrates with a hinge pin 50, with both components extending through the barrels. A set screw 52 extends through a bore 54 in the male barrel 46, and passes through a window 56 in the end cap 48 to engage an annular slot 58 in the hinge pin. This interface thus holds the end cap and the hinge pin together within the two barrels while allowing the barrels to rotate relative to each other, as well as to translate as described in more detail herein. A spring element 60 is integrated into the end cap and hinge pin arrangement to bias the male and female barrels together, as also described in more detail below.

Figure 10A:
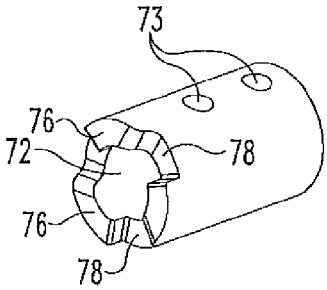
FIGS. 10*a-d* are perspective, side, cross-section and end views of a component of the hinge system shown in FIGS. 9*a-b*.
Figure 10B:
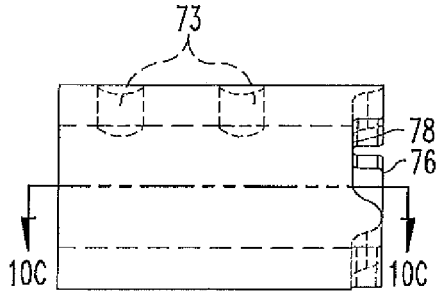
Figure 10C:
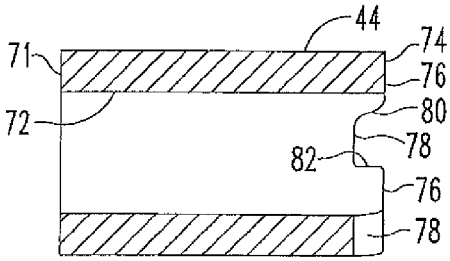
Figure 10D:
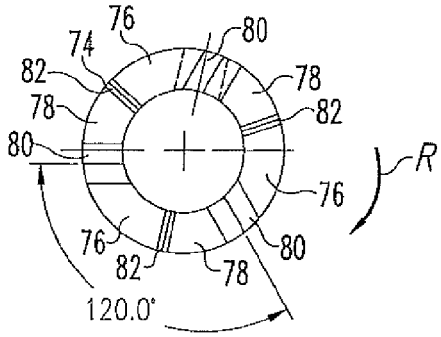

Turning to FIGS. 10*a*-*d*, the female hinge barrel 44 includes a cylindrical wall 71 defining a hollow interior 72. Mounting holes 73 may be provided in the wall 71 to facilitate attachment of the barrel to the mounting plate 42 or, alternatively, attachment of the barrel directly to the seat bottom 12*a*. The female barrel 44 integrates with the male barrel 46 by interlocking teeth. Thus, in the illustrated embodiment, the female barrel includes a plurality of teeth 76 separated by a like number of valleys 78 spaced around the circumference of the mating face 74 of the barrel. The surfaces of the teeth are preferably flat to provide a smooth sliding surface as the female barrel rotates relative to and against the male barrel. As shown in FIG. 10*d*, three teeth 76 and three valleys 78 are provided at 120° intervals around the circumference of the mating face 74.

The transition between the teeth and valleys is configured to facilitate relative rotation in one direction, while preventing rotation in the opposite direction. Thus, the transition in the direction of relative rotation R (FIG. 10*d*) includes a sloped surface 80, while the opposite transition 82 is abrupt and nearly perpendicular between the surfaces of the teeth and valleys.

Figure 11A:
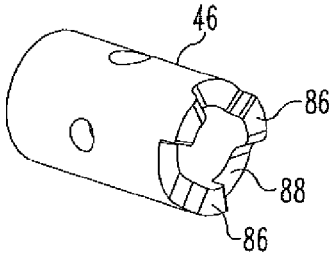
FIG. 11*a-e* are perspective, top, opposite side and end views of another component of the hinge system shown in FIGS. 9*a-b*.
Figure 11B:
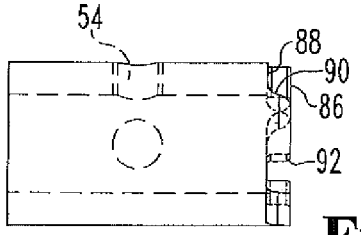
Figure 11C:
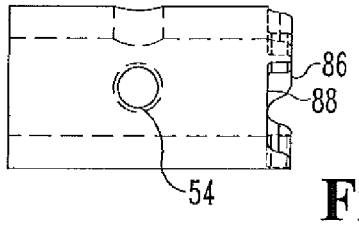
Figure 11E:
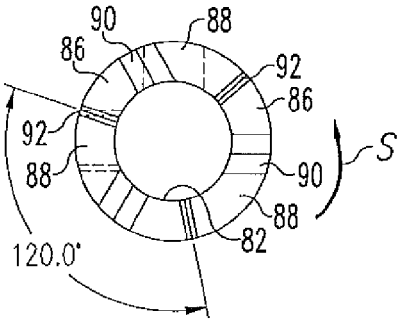
Figure 11D:
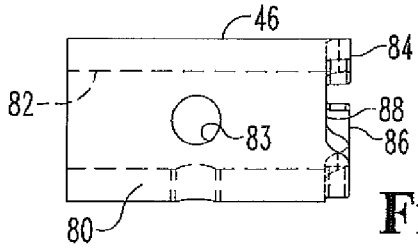
Figure 12A:
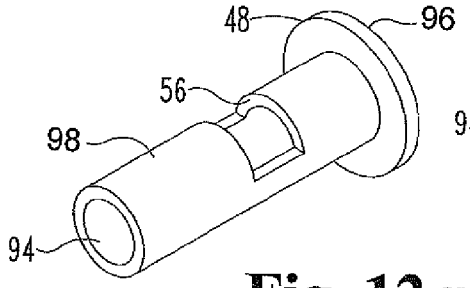
FIGS. 12*a-d* are perspective, top, side and end views of a further component of the hinge system shown in FIGS. 9*a-b*.
Figure 12B:
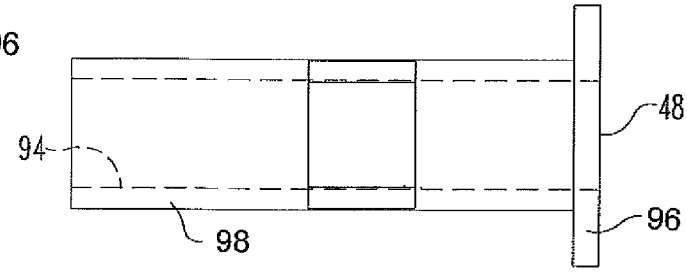
Figure 12C:
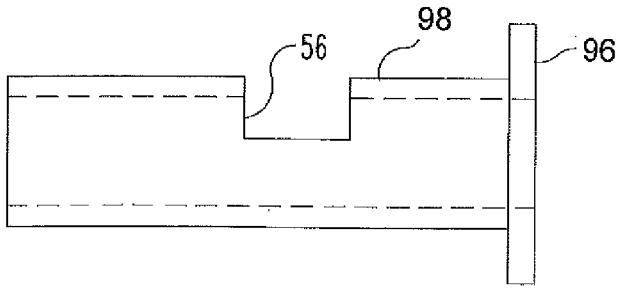
Figure 12D:
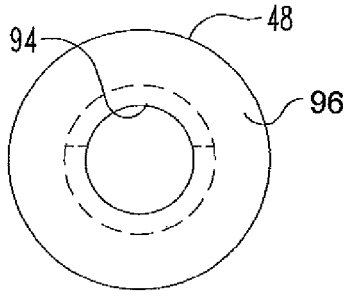

The male hinge barrel 46 is similarly configured, as depicted in FIG. 11*d*. The cylindrical wall 80 defines a hollow interior 82. The wall defines the threaded bore 54 for the set screw 52, as well as bore 83 used to attach the male barrel to the horizontal bar 22*c*. The interlocking face 84 of the male barrel defines a plurality of teeth 86 and valleys 88 that are complementary to the like components on the interlocking face 74 of the female barrel 44. The teeth and valleys are separated by sloped surfaces 90 and abrupt surfaces 92 just as in the female barrel. It should be noted that the orientation of these surfaces 90 and 92 is the opposite of the orientation on the female barrel because the relative direction of rotation S (FIG. 11*e*) of the male barrel is opposite to the direction of rotation R of the female barrel (FIG. 10*d*).

Thus, as shown in FIG. 7, when the barrels are interlocked, the teeth 76 of the female barrel 44 are disposed within the valleys 88 of the male barrel 46. Likewise, the teeth 86 of the male barrel are disposed within the valleys 78 of the female barrel. The barrels of the hinge 40 are aligned so that when the barrels interlock the seat shell is in its tilted position for storage. The interlocking teeth and valleys between the two barrels help hold the shell in its tilted position. The interface between the abrupt surfaces 82 and 92 prevents relative rotation of the hinge beyond the optimum tilt angle shown in FIG. 6.

When the seat shell 12 is moved to the seating position, the teeth and valleys of the two barrels disengage. As shown in FIG. 8, the teeth 76 and 86 contact each other, rather than the opposing valleys. The lands of the teeth have sufficient length to remain in contact until the seat shell has been tilted to an angle close to the storage angle shown in FIG. 6, at which time the angled surfaces 80 and 90 contact each other.

Figure 13C:
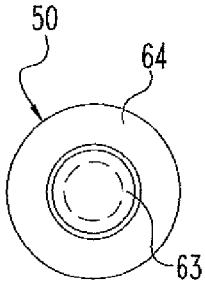
FIG. 13*a-c* are perspective, side and end views of another component of the hinge system shown in FIGS. 9*a-b*.
Figure 13B:
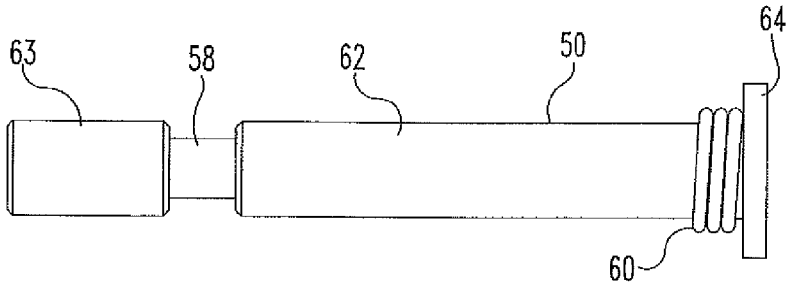
Figure 13A:
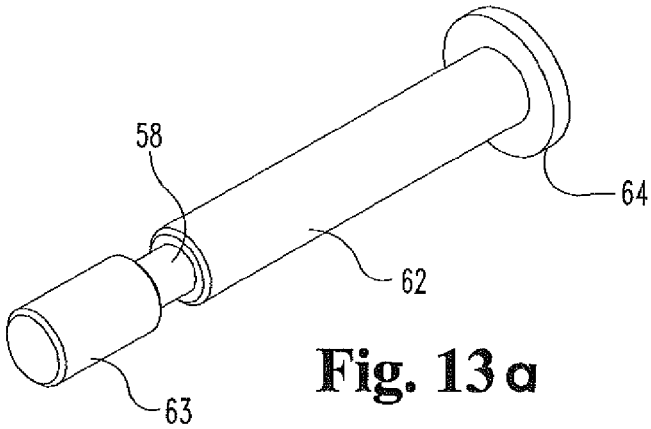

The barrels are maintained in contact by the end cap 48 and hinge pin 50, shown in FIGS. 12*a*-13*c*. As shown in FIGS. 12*a-d*, the end cap 48 includes an enlarged head 96 that bears against the end of the male barrel 46 as the cylindrical body 98 extends into the hollow interior 82. The body 98 of the end cap itself defines a hollow interior 94 into which the hinge pin 50 is inserted. The window 56 intersects the hollow interior so that the set screw can pass through the window into contact with the annular slot 58 of the hinge pin. As shown in FIGS. 13*a-c*, the hinge pin includes an enlarged head 64 that bears against the end of the female barrel. The hinge pin includes an elongated shaft 62 and 63 that is sized to pass freely through the hollow interior 94 of the end cap. The length of the shaft is such that the end shaft 63 is disposed between the window 56 and the head 96 of the end cap. The shaft is thus sized so that the annular slot 58 is aligned with the window 56. When the set screw 52 is threaded into the bore 54 of male barrel, it passes through the window and into the annular slot 58 to hold all three components together while permitting relative translation and rotation. The head 64 of the hinge pin 50 engages the end of the female barrel 44 while the head 96 of the end cap 48 contacts the end of the male barrel to complete the assembly. A spring 60 is disposed between the head 64 of the hinge pin and the end of the female barrel to exert a force tending to hold the two barrels in contact. The spring force thus resists axial movement of interlocking faces of the two barrels as the opposing teeth travel out of the opposing valleys during relative rotation of the two barrels. Once the teeth and valleys interlock in the tilted position (FIG. 8) the spring 60 tends to hold this interlock. The spring force can be overcome by manual pressure on the seat shell 12 to pivot it downward to the seating position.

Referring back to FIGS. 1-2, the tiltable table 100 includes a table top 102 that includes a horizontal portion 102*a* that serves as a desk surface and a vertical portion 102*b* that serves as an integral modesty panel. In the preferred embodiment, the horizontal and vertical portions are integral, joined by a curved portion 102*c*. The table top 102 may thus be formed or molded from a single piece of material that is lightweight yet tough enough to withstand normal use and abuse.

The table 100 further includes a rear leg frame 104 having a pair of vertical legs 108, and a front leg frame 110 having a like pair of legs 112. The two leg frames are connected by a cross bar 120 that serves as the pivot point for the table top, as described herein. In the preferred embodiment, the leg frames 104 and 110, and the cross bar 120 are of tubular construction and are fastened together in a known manner, such as by welding. A brace bar 114 is provided between corresponding legs 108, 112 to add stability to the construction of the table base. As shown in the figures, the ends of the respective legs 108, 112 can be provided with caster wheels 106 to facilitate transport and storage of the table 100.

While the rear legs 108 are generally vertical (although some curvature may be introduced for aesthetics), the front legs 112 exhibit a highly curved configuration for both aesthetic and functional reasons. Each leg 112 includes a lower portion 112*a* at the end of which a caster wheel 106 is fastened. The lower portion 112*a* curves upward and rearward toward the cross bar 120 so that the lower portion 112*a* of the front legs 112 and the rear legs 108 form a stable base to support the table top 102. The front legs 112 also include an upper portion 112*b* that extends upward and forward from the cross bar 120. The upper portion of each leg, and more particularly the end 112*d*, supports the horizontal desk portion 102*a* of the table top, as seen in FIG. 14*a*.

Figure 14A:
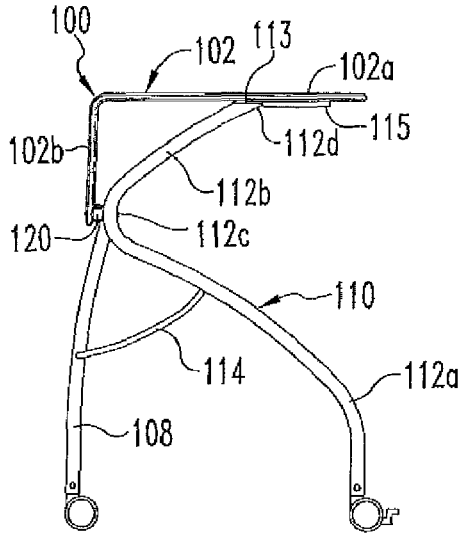
FIGS. 14*a-b* are side and front views of the tiltable nestable table shown in FIG. 1, with the table top in its "in use" position.
Figure 14B:
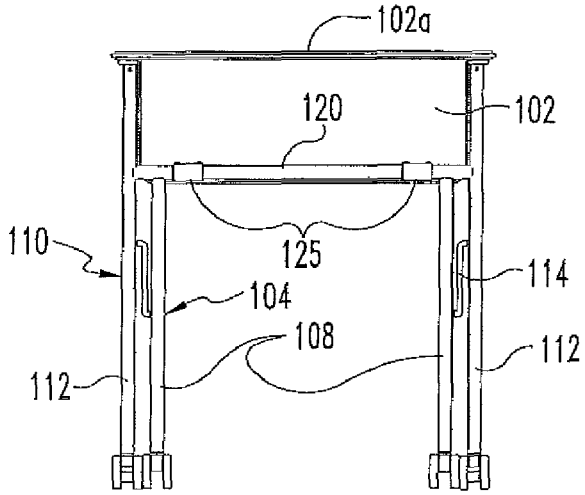
Figure 15A:
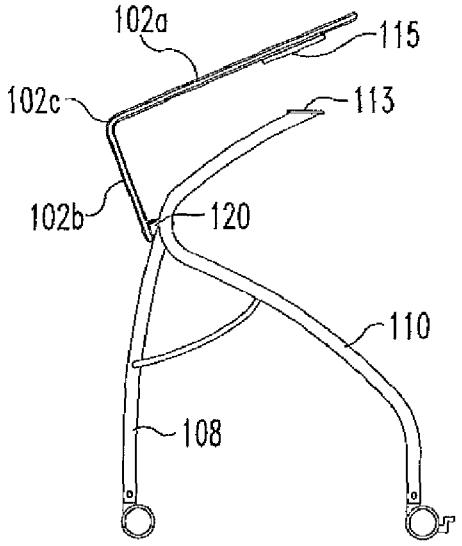
FIGS. 15*a-b* are side and front views of the tiltable nestable table depicted in FIG. 2, with the table top in its tilted position.
Figure 15B:
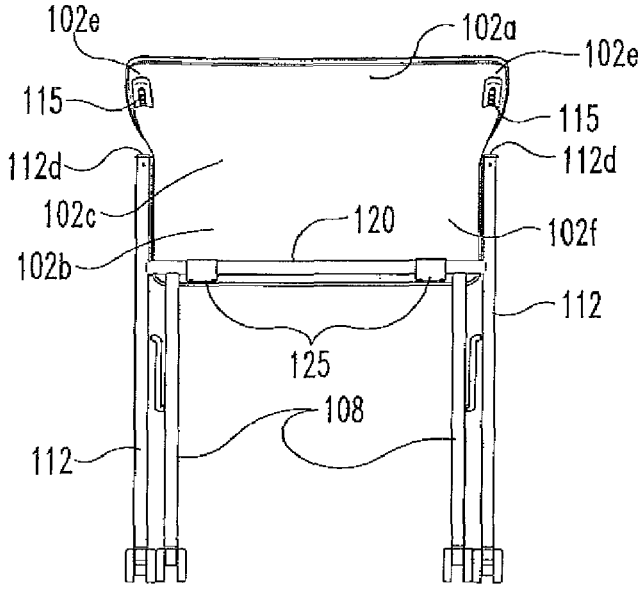

The table 100 is shown in more detail in its in use position in FIGS. 14*a-b* and in its tilted or stowed position in FIGS. 15*a-b*. As can be seen in the front-on view of FIG. 14*b*, the rear leg frame 104, and more particularly the rear legs 108, are inboard of the front leg frame 110 and front legs 112. This orientation allows the rear leg frame of one table to nest within the front leg frame of an adjacent table when the tables are horizontally nested, as illustrated in FIG. 2. As with the chair 10 discussed above, this feature of the table 100 allows tables to be nested in as little longitudinal length as possible. In the specific embodiment depicted in FIG. 2, the length of three nested tables is only about 30% greater than the wheelbase of a single table.

Turning to FIGS. 15*a, b*, the ends 112*d* of the front legs 112 can be provided with a pad 113 to cushion and support the desk surface 102*a*. Thus, the pad may be formed of a resilient, slightly elastic material, such as a polyurethane pad, affixed to the ends 112*d* of the legs. The underside of the desk surface 102*a* may be provided with a catch 115 aligned with each end 112*d* or pad 113 to provide an interlock between the desk top 102 and the legs 112. The catch 115 prevent flexing of the desk top in use and may be configured to provide a friction latch between the catch 115 and the pad 113 when the two components are in contact. Alternatively, the pad 113 and catch 115 may be replaced with a mechanical latch construction that positively locks the table top 102 in the in use position.

As more clearly shown in FIG. 15*b*, the table top 102 flares outward from one width at portion 102*f* to a larger width at the wings 102*e*. It can be appreciated that the narrower width portion 102*f* allows the table top to fit between the legs 112 of the front leg frame. This aspect allows a tilted table to nest within an adjacent tilted table, as shown in FIG. 2. On the other hand, the wider width of the wings 102*e* is necessary to allow the desk top 102*a* to contact and rest on the ends 112*d* of the front legs. Moreover, the wings 102*e* increase the working area of the desk top closest to the user.

As shown in FIGS. 14*b*, 15*b*, the table top 102 is mounted to the cross bar 120 of the table base frame by way of hinges 125. The hinges are configured to hold the desk top 102 in the tilted position shown in FIG. 15*b* as the desk 100 is transported and manipulated into a storage stack. The hinges 125 are further configured to be readily disengaged by manually pivoting the table top back to the in use position of FIG. 14*b*.

Figure 16B:
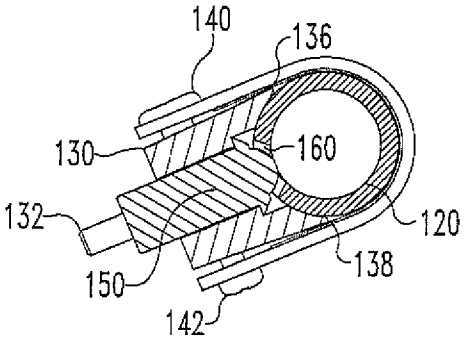
FIGS. 16*a-c* are exploded perspective and enlarged cross-section views of a hinge of the table shown in FIGS. 14-15.
Figure 16C:
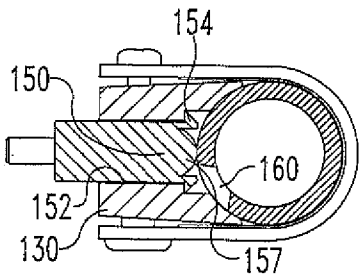
Figure 16A:
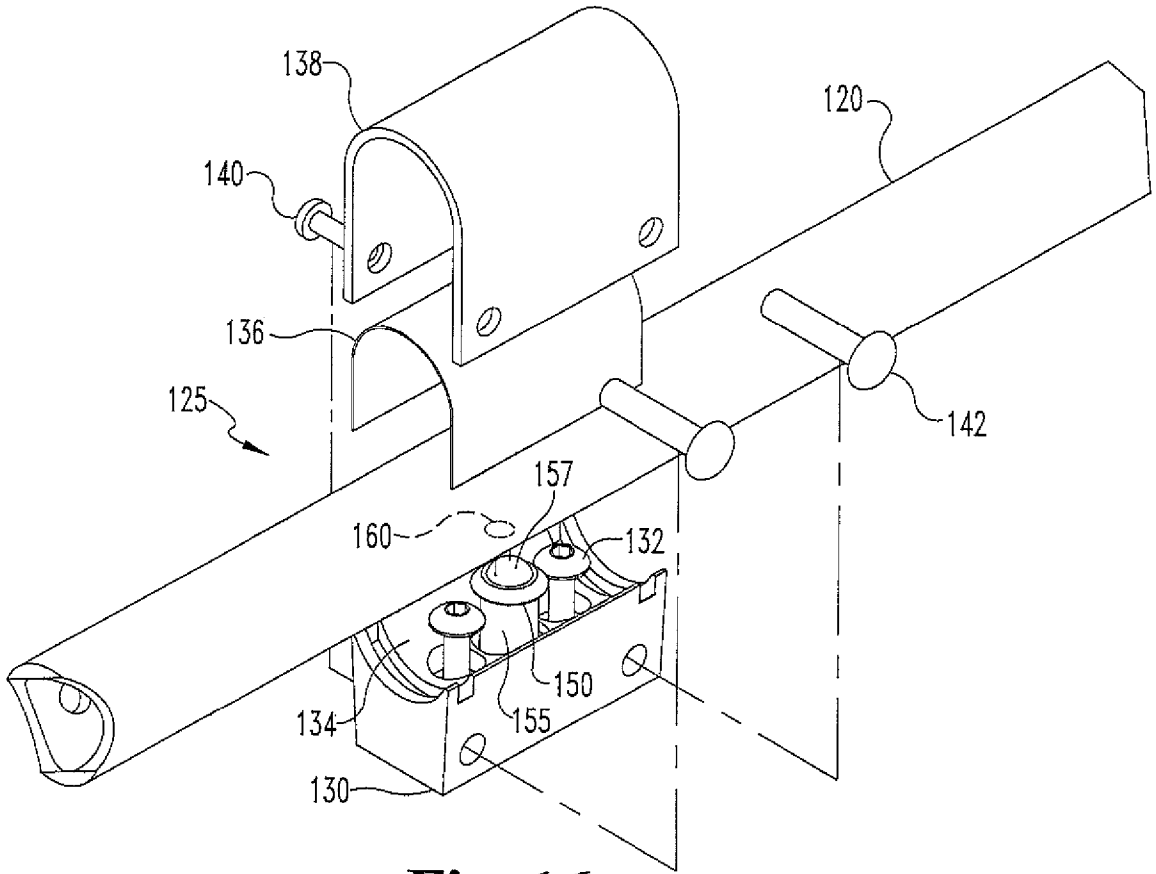

Details of the hinges 125 are found in FIGS. 16*a-c*. As shown in the exploded view of FIG. 16*a*, the hinge 125 includes a mounting block 130 that is fastened to the inside of the modesty panel 102*b* of the table top 102 (FIG. 15*a*) by screws 132 or by other suitable means for fastening, including by welding or epoxy depending upon the materials of the table top and the mounting block. The mounting block defines a channel 134 that is complementary with the surface of the cross bar 120 so that the bar can seat snugly therein. In the illustrated embodiment, the cross bar 120 is cylindrical so the channel 134 is semi-cylindrical. The cross bar and channel may adopt other configurations provided that the hinge retains the ability to rotate relative to the cross bar as the table top is pivoted.

The cross bar 120 is held within the channel 134 by a U-shaped bearing sheet 136 held in place by a U-shaped cover plate 138. The cover plate 138 is fastened to the outside of the mounting block 130 by suitable means, such as by a screw 140 and barrel nut 142 arrangement passing entirely through the mounting block. The bearing sheet and cover plate are configured to conform to the surface of the cross bar 120, such as in the semi-cylindrical shape shown in FIG. 16*a*. The cover plate 138 is configured to retain the cross bar snugly within the channel 134 of the mounting block while still allowing relative rotation between the components. The bearing sheet 136 is formed of a material that provides a lower friction bearing surface to facilitate this relative rotation. Thus, in one embodiment, the bearing sheet is a plastic sheet that can be easily bent into the requisite U-shape to fit within the cover plate. The surface of the channel 134 in the mounting block may also be formed of a bearing material. In one embodiment, the entire block 130 is formed as a zinc casting which provides a low wear surface for the cross bar to rotate upon.

The hinge 125 includes a spring-biased plunger element 150 that operatively engages a hole or countersink 160 in the cross bar 120 to hold the hinge 125, and therefore the desk top 102, against rotation relative to the cross bar. Thus, as shown in FIG. 16*b*, the plunger element 150 engages the hole 160 to hold the desk top in the tilted position. When the desk top is rotated to its in use position (FIG. 14*a*), the plunger element is disengaged from the hole 160. The plunger element resides within a bore 152 and cavity 154 defined in the mounting block 130. The plunger element 150 can be of a variety of configurations that are capable of resiliently moving between the configurations illustrated in FIGS. 16*b, c*. In one embodiment, the element has a casing 155 that contains a ball 157 and a spring (not shown) disposed within the casing and bearing against the ball. As the hinge 125 is rotated relative to the cross bar 120, the ball 157 rides up the edge of the hole 160 in the cross bar and exits the hole. As the ball moves, it depresses the spring within the casing 155. As shown in FIGS. 16*b-c*, the hole can have a beveled surface to facilitate movement of the ball out of the hole. The hole 160 may be in the form of a through hole or a depression formed in the surface of the cross bar with sufficient depth to capture the ball 157 therein.

Conversely, when the hinge is rotated relative to the cross bar to the position in FIG. 16*b*, the spring pushes the ball outward into the hole 160. It can be appreciated that the stiffness of the spring of the plunger element 150 determines the relative ease with which the hinges 125 are rotated to disengage the cross bar. It can further be appreciated that the table top 102 itself will provide a mechanical advantage, or fulcrum, when manual pressure is applied at the front edge of the desk top portion 102*a*. This mechanical advantage thus allows the use of a stiff spring in the plunger element, since the moment arm of the desk top will allow the spring force to be readily overcome by the user. On the other hand, the stiffer the spring, the greater the spring force available to hold the plunger in its engagement position when the desk top is tilted. Any normal vibration or jostling of the table 100 as it is being transported and/or stowed will be unable to overcome this spring force to cause the table top to accidentally fall.

As indicated in FIG. 15*a*, the hinges are configured to support the table top at a tilt angle of about 23°. At this angle, the center of gravity of the table top is sufficiently far forward relative to the front and rear leg frames to prevent the tilted table from tipping over backwards. As is clear from the figures, the forward pivoting of the table top 102 is limited by contact between the wings 102*e* of the table top and the ends 112*d* of the front legs. On the other hand, rearward pivoting of the table top is limited by contact between the lower edge of the modesty panel 102*b* and the rear legs 108, as can be seen in FIGS. 15*a, b*. As best seen in FIG. 15*b*, the width of the lower portion 102*f*, which includes the modesty panel 102*b*, is greater than the spacing between the rear legs 108 so that the desk top is unable to pivot past the legs. Thus, the table 100 is configured so that the desk top can never be moved to an unstable position.

The chair 10 and table 100 disclosed herein are well suited for office, conference, training and even classroom settings. Both units are capable of horizontal nesting to conserve space or permit storage of a large number of tables and chairs in a given storage space. In certain embodiments, the three chairs or tables can be nested in a length that is only about 30% greater than the wheel base of a single chair or table. Horizontal nesting means that deployment or storage can be easily accomplished by nearly anybody. The compact horizontal nesting capabilities of the chair and table disclosed herein eliminate the problems and risks associated with vertical stacking. Moreover, the tilting features disclosed herein avoid the complicated and troublesome mechanisms required to completely fold a table or chair.

The hinges of the disclosed chair and table provide a safe and convenient manner for stowing the items. The hinges engage the respective seat back or table top in the tilted position with sufficient force to avoid accidental deployment or pivoting. At the same time, the seat back and table top provide a fulcrum that allows a typical user to easily overcome the retention force of the hinges to move the element to its in use position. The chair and table disclosed herein are further configured to hold their respective in use positions by using only the weight of the seat back or table top and without the need for additional mechanisms.

What is claimed is:

1. A nestable table comprising:

a one piece table top having a desk portion and an integral modesty panel extending generally perpendicularly downward from said desk portion;

a table base including a front leg frame and a rear leg frame, said front leg frame having a pair of front legs spaced apart a first distance, and said rear leg frame having a pair of rear legs spaced apart a second distance less than said first distance to permit nesting of the rear legs of one table within a pair of front legs of an adjacent horizontally nested table;

at least one hinge engaged between said table top and said table base, said hinge configured to permit relative rotation between said table top and said base between an in use position in which the table top is in position for a person to use the desk portion and a stowed position in which said table top is tilted upward from said in use position, wherein said hinge is engaged between a portion of said modesty panel adjacent a lower edge thereof and said table base at a location generally vertically aligned with said rear legs of said rear leg frame.

2. The nestable table of claim 1, wherein said table top has a first width including said modesty panel and a portion of said table top that is sized to fit between the front legs of an adjacent horizontally nested table.

3. The nestable table of claim 2, wherein:

said table top has a front edge portion having a second width that is greater than said first width each front leg of said front leg frame includes a upper portion with an end arranged to support said front edge portion of said table top in the in use position.

4. The nestable table of claim 3, wherein said end of each front leg includes a pad to support said table top thereon.

5. The nestable table of claim 1, wherein said rear legs of said table base define a rear vertical plane, and said at least one hinge is configured so that in said stowed position the center of gravity of said tilted table top is in front of said rear vertical plane.

6. The nestable table of claim 5, wherein said at least one hinge is configured so that in said stowed position said table top is tilted at an angle of about 23 degrees relative to the horizontal.

7. The nestable table of claim 1, wherein said at least one hinge is mounted to said table base so that said lower edge of said modesty panel contacts said rear leg frame when said table top is tilted past said stowed position.

8. The nestable table of claim 1, wherein:

said table base includes a cross bar spanning between said front legs, said cross bar defining a hole therein corresponding to each of said at least one hinge; and said hinge includes;

a mounting block fastened to the inside of said modesty panel;

a spring-biased plunger carried by said mounting block; and a cover plate adapted to hold said cross bar to said mounting block with each hole aligned with a plunger when said table top is in said tilted position;

wherein said plunger is biased to enter said hole in said cross bar to hold said cross bar in position relative to said table base.

9. The nestable table of claim 8, wherein said mounting block defines a channel configured to receive the cross bar for rotation therein.

10. The nestable table of claim 8, wherein said hinge further includes a bearing sheet disposed between said cover plate and said cross bar when the cover plate holds the cross bar to said mounting block.

11. The nestable table of claim 1, wherein said table base includes a brace bar spanning between a front leg and a rear leg on each side of the table.

* * * * *